US007975716B1

(12) United States Patent
Mullally

(10) Patent No.: US 7,975,716 B1
(45) Date of Patent: Jul. 12, 2011

(54) SOLENOID VALVE PUCK ASSEMBLY AND METHOD

(75) Inventor: Michael J. Mullally, Clifton Springs, NY (US)

(73) Assignee: Valve Tech, Inc., Phelps, NY (US)

( * ) Notice: Subject to any disclaimer, the term of this patent is extended or adjusted under 35 U.S.C. 154(b) by 1039 days.

(21) Appl. No.: 11/131,494

(22) Filed: May 18, 2005

(51) Int. Cl.
*B25B 27/24* (2006.01)

(52) U.S. Cl. ..... 137/315.03; 137/315.41; 137/15.17; 251/129.15; 251/357; 251/333; 29/213.1; 29/270; 29/890.12

(58) Field of Classification Search ..... 251/359, 251/357, 129.15; 137/315.41, 315.42, 315.03, 137/15.01, 15.08, 15.17, 15.18; 29/213.1, 29/270, 602.1, 890.12, 890.121, 890.122, 29/890, 123, 890.124
See application file for complete search history.

(56) References Cited

U.S. PATENT DOCUMENTS

| | | | | | |
|---|---|---|---|---|---|
| 2,438,642 | A * | 3/1948 | Martin | 29/235 |
| 3,550,614 | A * | 12/1970 | Marandi et al. | 137/245 |
| 3,712,581 | A * | 1/1973 | Parlow | 251/129.15 |
| 4,917,351 | A * | 4/1990 | Lindbloom et al. | 251/129.18 |
| 5,161,778 | A * | 11/1992 | Motykiewicz | 251/129.15 |
| 5,199,398 | A * | 4/1993 | Nylund | 123/299 |
| 5,404,908 | A * | 4/1995 | Reinicke | 137/595 |
| 6,003,551 | A | 12/1999 | Wears | 137/625.33 |
| 6,012,209 | A * | 1/2000 | Whetstone | 29/235 |
| 6,135,132 | A | 10/2000 | Welker et al. | |
| 6,225,886 | B1 * | 5/2001 | Kleinert et al. | 335/257 |

* cited by examiner

*Primary Examiner* — John K Fristoe, Jr.
*Assistant Examiner* — Andrew J Rost
(74) *Attorney, Agent, or Firm* — Eugene S. Stephens

(57) ABSTRACT

A puck retaining recess in a plunger of a solenoid valve is formed with a puck retaining lip that is fixed or unified with the plunger. The puck is then radially compressed to fit through a central opening of the retainer lip, and once the puck is pushed past the retainer lip, it is allowed to radially expand within the recess where the puck is retained between a bottom of the recess and the retainer lip. This eliminates many problems that previously occurred with separable retainer lips pressed into position to hold a puck after its insertion into a plunger recess.

9 Claims, 2 Drawing Sheets

SOLENOID VALVE PUCK ASSEMBLY AND METHOD

BACKGROUND

Some solenoid valves, such as those used in space vehicles, require special accuracy and durability, because malfunctions and leaks can have serious or expensive consequences. Such solenoid valves can rely on elastomeric valve closing pucks that are carried by an armature or plunger of a solenoid to seal against a valve seat when moved to a closed position. Achieving such valve closing pucks that can endure the many opening and closing movements without developing leaks has required expensive attention to detail, and even then, reliability needs improvement.

Prior art methods of assembling an elastomeric puck into a recess of a solenoid plunger have involved positioning the puck within the recess, and then pressing a lipped retainer into the plunger to hold the puck in place in the recess. This involves careful machining of the recess and the retainer lip so that they fit accurately enough to reliably retain the puck. It also involves placing the puck so that the retainer holds the puck in an optimum position for operation. Errors occurring in these steps can spoil the performance of the valve and thereby become costly.

This invention aims to overcome the prior art problems of assembling valve closing pucks into solenoid plungers, and to do so in a simpler and more reliable way that allows the pucks to seal repeatedly for the operating life of the valve. The invention also aims to accomplish these improvements with less expensive procedures than have previously been used.

SUMMARY

The inventive assembly of an elastomeric puck into a recess in a solenoid plunger does not use a separable retainer lip. Instead, it machines or otherwise integrates a retainer lip with a puck holding recess formed in the plunger. Since the retainer lip has an inside diameter less than a diameter of the puck, the assembly involves radially compressing the puck to press it through the inside opening of the retainer lip and into the recess where the puck expands radially to be trapped between a bottom of the recess and the retainer lip.

Experience has shown that a puck can be quickly placed accurately within a recess in a plunger by pushing the puck through an insertion tool having a conical inside surface with a diminishing internal diameter so that pushing the puck through the insertion tool radially compresses and axially expands the puck. With an exit opening from the insertion tool registered with the inside diameter of the retainer lip of the recess, the puck can be pushed into the recess, past the retainer lip, and into a trapped position. There, the puck is preferably compressed and retained between a bottom of the recess and the retainer lip. Experience has also shown that pucks assembled into plungers in the inventive way perform accurately and reliably at least equal to the best performances of previously assembled pucks, without incurring the previous expense.

DRAWINGS

DETAILED DESCRIPTION

Figure 1:
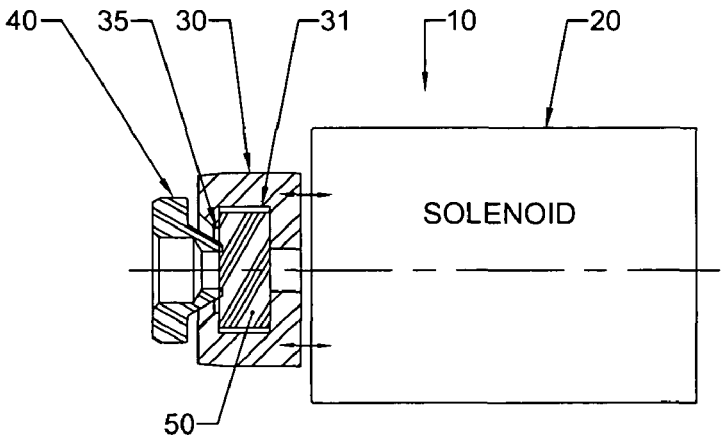
FIG. 1 is a partially schematic view of a solenoid valve having a plunger carrying a puck assembled in the inventive way and showing the puck in a closed valve position.
Figure 2:
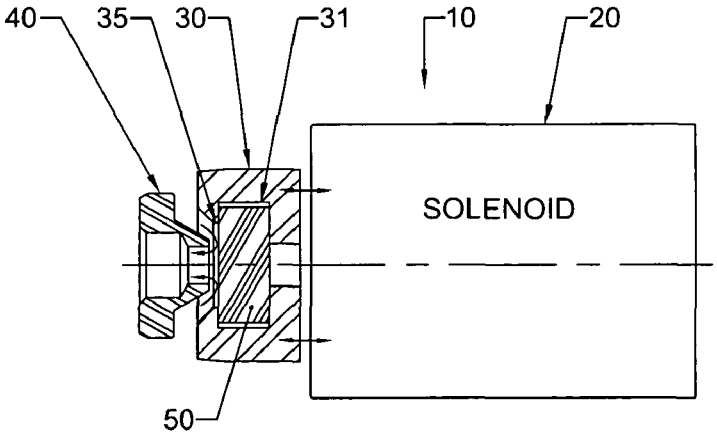
FIG. 2 is a partially schematic view similar to the view of FIG. 1, but showing the plunger and puck in a valve open position.
Figure 3:
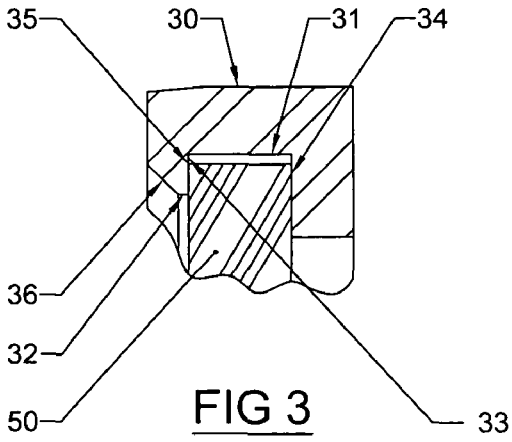
FIG. 3 is an enlarged fragmentary view of a plunger and puck as shown in FIGS. 1 and 2.

FIGS. 1 and 2 schematically show a solenoid valve 10 including a solenoid 20, a plunger or armature 30, and a valve seat 40. An elastomeric, valve closing puck 50 closes valve 10 in FIG. 1 and opens valve 10 in FIG. 2 where plunger 30 is pulled by solenoid 20 away from valve seat 40. Many details of operation of solenoid valve 10 are omitted for clarity of illustration. These include a spring bias for plunger 30, the arrangement of coil and magnetic flux path for solenoid 20, and fluid flow up to and through valve seat 40. These details are known in the solenoid art and are not necessary to the illustration of the inventive puck assembly and method.

Plunger 30 has a recess 31 receiving puck 50, and a retainer lip 35 that holds puck 50 in place within recess 31. Retainer lip 35 is preferably machined from the same piece of steel that forms plunger 30, with its recess 31. This can ensure that a central i.d. or opening in lip 35 is accurately concentric with recess 31, which is preferably cylindrical. It also establishes the correct axial distance between an inside 33 of lip 35 and a bottom 34 of recess 31. The recess 31 and retainer lip 35 are thus integral or unified before puck 50 is inserted, and lip 35 is fixed in place before, rather than after, puck 50 is positioned within plunger 30.

Besides machining lip 35 of a single piece of metal that includes plunger 30, it is possible to form these two elements of separate pieces that are accurately fixtured and then welded together. Separate fabrication and welding introduces a possibility for error, and is to be avoided if possible. Separate fabrication and welding of lip 35 may be used for a recesses 31 that becomes too minute to machine in a single piece, but whenever possible, single piece construction is preferred.

Lip 35 preferably has an inclined surface 36 leading toward opening or i.d. surface 32. Surface 36 thus slopes downward and inward toward recess 31, and this can facilitate the entry of puck 50 into recess 31, as shown in FIGS. 4-7.

Figure 4:
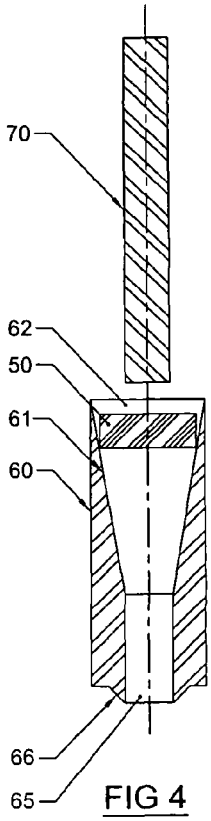
FIGS. 4-7 are partially schematic, cross-sectional views showing respectively: A puck positioned in the entry of an insertion tool in FIG. 4, a puck pushed part-way through the insertion tool in FIG. 5, a puck pushed nearly to the exit of an insertion tool in FIG. 6, and a puck pressed into a plunger recess in FIG. 7.
Figure 5:
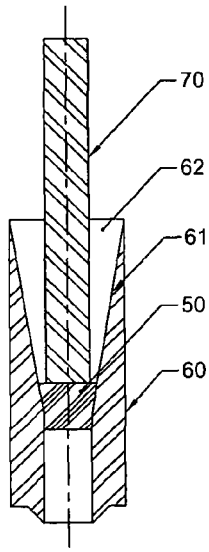
Figure 6:
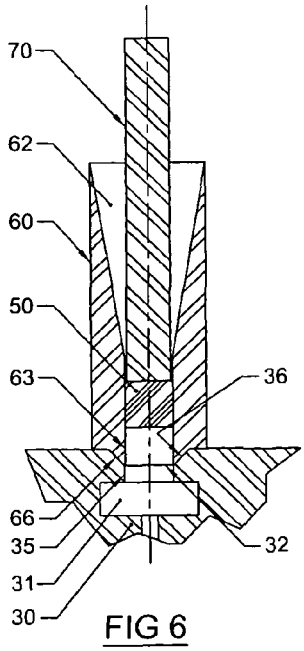
Figure 7:
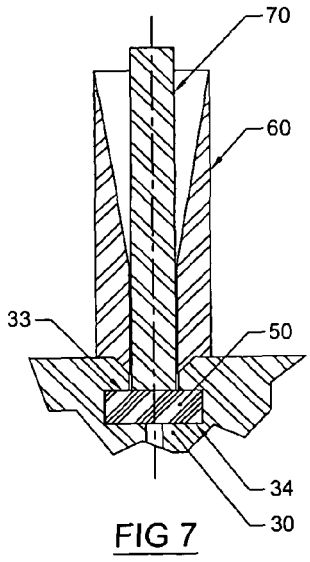

A puck insertion tool 60, as shown in FIGS. 4-7, preferably has an inclined surface 66 surrounding an exit opening 65 to seat against retainer lip surface 36, as shown in FIGS. 6 and 7. This positions insertion tool 60 for inserting puck 50 into recess 31 in movements illustrated in FIGS. 4-7.

Insertion tool 60 preferably has a conical surface 61 having a diminishing inside diameter proceeding from a puck entry region 62 toward puck exit region 65. A puck 50 is positioned in entry region 62 so that an axis of puck 50 is concentric with an axis of insertion tool 60. A push rod 70 can then drive puck 50 downward through insertion tool 60 and into recess 31, as illustrated.

As puck 50 advances from the position of FIG. 4 to the position of FIG. 5, it is radially compressed by moving downward through the diminishing inside diameter of conical surface 61. This radially compresses and axially lengthens puck 50 as illustrated.

When puck 50 reaches cylindrical surface 63 near the exit end 65 of insertion tool 60, it is radially compressed enough to fit through the inside opening 32 of lip 35 of plunger 30, as best shown in FIG. 6.

When push rod 70 advances a full stroke as shown in FIG. 7, it pushes puck 50 fully into recess 31. There, puck 50 radially expands to its original radial size within recess 31 where puck 50 is trapped or retained, preferably by being axially compressed between lip surface 33 and recess bottom 34.

Puck 50 can be formed of various materials, as is generally known in the solenoid valve art. Preferably puck 50 is die cut from a sheet of suitable material, which is generally compressible and elastomeric. The material for puck 50 must also be compatible with the fluid being valved and must be durable enough to survive the intended number of valve openings and closings.

Plunger 30 is preferably machined of a single piece of steel, especially if plunger 50 also serves as the armature for solenoid 20. Many different configurations of plungers are possible, as is known in the solenoid arts, and in some configurations, it may be possible to form a puck carrying plunger of other metals or other materials.

A lubrication helps move puck 50 through insertion tool 60, and various lubrications can be used, providing they are compatible both with puck 50 and insertion tool 60. Alcohols have been used successfully, but other lubricants are available depending primarily on the material selected for puck 50.

What is claimed is:

1. A method of making and assembling a disk-shaped elastomeric puck into a recess of a plunger of an aerospace solenoid valve, the method comprising:

die cutting the puck from a sheet of material so that the puck has a cylindrically cut edge and a uniform thickness between axial faces of the puck;

manufacturing the recess to have a fixed puck retaining lip and a diameter larger than a diameter of the puck in a region between the lip and a bottom of the recess;

positioning the puck in a tool having a conical inside surface with a diminishing internal diameter registered with an opening in the retaining lip so that the cylindrical surface of the puck engages the conical inside surface;

forcing the puck through the conical surface so that the puck is radially compressed and axially elongated as the puck advances;

forcing the radially compressed puck through a region where the internal diameter registers with the opening in the retaining lip so that the puck passes through the retainer lip and into the recess;

allowing the elastomeric puck to expand radially into a portion of a radial space available within the recess to a position in which:

a) the puck has a radial clearance within the recess, b) the puck is axially compressed between an inner edge of the lip and a bottom of the recess;

c) the axial compression holds the puck in a fixed position within the recess, and d) an outer axial face of the puck is disposed to extend across the opening at the inner edge of the lip where it can engage a valve seat within the opening in the lip.

2. An aerospace fluid valving plunger and puck assembled by the method of claim 1.

3. A method of combining a disk-shaped elastomeric valve closing puck with a plunger of an aerospace solenoid valve, the plunger having a recess dimensioned to receive the puck and a lip dimensioned to retain the puck in the recess, the method comprising:

die cutting the puck from a sheet of material so that the puck has a cylindrical die cut surface and axially opposite and parallel plane faces;

unifying the lip with the recess in the plunger;

compressing the elastomeric puck radially enough to move the puck through an opening in the lip while allowing the puck to expand axially; and forcing the radially compressed puck into the recess so that the puck expands radially within the recess to leave a radial clearance between the puck and the recess and the puck expands axially to retain the puck concentrically within the recess and to hold the puck against movement within the recess by compressing the puck between an inner edge of the lip and a bottom of the recess, and to dispose a valve-closing axial face of the puck at the inner edge of the lip to engage a valve seat in a region within the opening in the lip.

4. The method of claim 3 including compressing the puck radially by forcing the cylindrically cut surface of the puck axially into a conical bore of diminishing internal diameter before forcing the puck through the lip.

5. A combination of an aerospace valve plunger and a puck assembled by the method of claim 3.

6. An assembly of valve-closing elastomeric puck and an aerospace solenoid plunger having a recess configured to receive the puck, the recess and the puck each being cylindrical, and comprising:

the recess and a retainer lip for the recess being manufactured of a single piece of metal;

the retainer lip having an opening with an internal diameter less than a diameter of the recess;

the puck having a cylindrically cut diameter larger than the internal diameter of the lip and smaller than an internal diameter of the recess;

the lip being spaced axially from a bottom of the recess by a distance less than an axial thickness of the puck;

the puck is held in place concentrically within the recess by being compressed between an inner edge of the lip and the bottom of the recess;

a valve closing face of the puck extending across an inside of the opening in the lip to engage a valve seat at an exposed face of the puck within inner edge of the opening in the lip; and the puck and recess diameters ensuring that the puck has radial expansion room when held within the recess, and the axial thickness of the puck and the spacing of the lip axially from the bottom of the recess ensuring that the compression holding the puck in place does not allow the puck to move within the recess.

7. A method of assembling the assembly of claim 6 including forcing the puck through a tool having a conical internal surface engaging the cylindrical cut surface of the puck and leading to the internal diameter of the lip so that the puck passes through the tool, through the lip and into the recess under the lip.

8. A compressible and elastomeric and disk-shaped valve-closing puck retained in a recess of an aerospace solenoid plunger in a combination comprising:

the recess and a lip of the recess having a shape that results from being manufactured integrally of a metal;

the lip having an opening concentric with the recess;

the lip being spaced from a bottom of the recess;

the puck being held against movement within the recess in a position compressively engaging the lip and the bottom of the recess;

the puck being concentric with the recess and having a radial clearance within the recess;

the puck having a diameter larger than the opening in the lip and smaller than an internal diameter of the recess; and a valve closing face of the puck extending over an inner edge of the opening in the lip where the puck is disposed to engage a valve seat at the inner edge of the opening in the lip.

9. A method of assembling the combination of claim 8 including forcing the puck through a conical bore of diminishing internal diameter engaging the cylindrical cut surface of the puck to insert the puck through the lip and into the recess.

* * * * *